US006625908B1

(12) United States Patent
Cardiff et al.

(10) Patent No.: US 6,625,908 B1
(45) Date of Patent: Sep. 30, 2003

(54) APPARATUS FOR DIGGING A TRENCH

(76) Inventors: Darren Cardiff, 396 Stenner Street, Toowoomba, QLD 4350 (AU); Steven Nuttall, 396 Stenner Street, Toowoomba, QLD 4350 (AU)

( * ) Notice: Subject to any disclaimer, the term of this patent is extended or adjusted under 35 U.S.C. 154(b) by 0 days.

(21) Appl. No.: 09/937,527

(22) PCT Filed: Mar. 24, 2000

(86) PCT No.: PCT/AU00/00243

§ 371 (c)(1),
(2), (4) Date: Dec. 18, 2001

(87) PCT Pub. No.: WO00/56985

PCT Pub. Date: Sep. 28, 2000

(30) Foreign Application Priority Data

Mar. 24, 1999 (AU) ..... PP 9398

(51) Int. Cl.[7] ..... E02F 5/02

(52) U.S. Cl. ..... 37/357; 37/359; 37/190; 37/465

(58) Field of Search ..... 37/190, 189, 462, 37/465, 347, 348, 352, 353, 355, 356, 357, 359, 364, 365, 91, 92–97, 375

(56) References Cited

U.S. PATENT DOCUMENTS

| | | | | | |
|---|---|---|---|---|---|
| 2,237,773 | A | * | 4/1941 | Van Voorhis et al. | |
| 3,681,863 | A | * | 8/1972 | Solntsev et al. | 37/97 |
| 3,815,266 | A | * | 6/1974 | Schmitz et al. | |
| 4,161,072 | A | * | 7/1979 | Pronovost | 37/93 |
| 4,535,555 | A | * | 8/1985 | Petraud | 37/94 |
| 4,691,455 | A | * | 9/1987 | Newman | 37/103 |
| 4,704,811 | A | * | 11/1987 | Jefferson | |
| 5,497,567 | A | * | 3/1996 | Gilbert | 37/352 |
| 5,846,026 | A | * | 12/1998 | Gilbert et al. | 405/179 |
| 5,857,274 | A | * | 1/1999 | Rudiger et al. | 37/190 |

* cited by examiner

*Primary Examiner*—Christopher J. Novosad
(74) *Attorney, Agent, or Firm*—Simpson & Simpson, PLLC

(57) ABSTRACT

An apparatus for digging a trench including a cutter device for cutting through a ground surface and a guide with a loading end located rearwardly of the cutting device and adapted for guiding earth from the loading end to an off loading end as the apparatus moves in a forward direction.

29 Claims, 10 Drawing Sheets

APPARATUS FOR DIGGING A TRENCH

FIELD OF THE INVENTION

The present invention relates to excavation machines.

In particular the present invention relates to machines which are used to dig a trench for a pipeline.

BACKGROUND OF THE INVENTION

A conventional way of digging a trench for a pipeline requires the use of a machine which has an hydraulically controlled arm with an excavating bucket at its lower end. Earth is removed from the trench by the excavation bucket scooping up the earth and depositing it to one side.

As a result of the digging operation described above a trench is constructed of a generally rectangular cross-section.

The problem with digging a trench with a generally rectangular cross-section is that more earth is removed from the trench than actually needs to be moved in order to deposit a length of pipe in the trench. Furthermore the machinery currently available to dig trenches does not allow a long trench to be excavated at a satisfactory rate, in part because the trench is formed with a generally rectangular cross-section and this requires that the walls of the trench must be stable. Accordingly considerable effort must be exerted in order to ensure that any excavating machinery does not collapse the trench wall and this results in the limitation on the speed of movement of excavating equipment.

The present invention provides an alternative method and apparatus for digging a trench. In its preferred form the apparatus is directed to digging a trench which has a generally V-shaped or wedge-shaped cross-section with the resultant benefit that less earth needs to be removed in a trench digging operation.

SUMMARY OF THE INVENTION

According to one aspect of the present invention there is provided an apparatus for digging a trench including a cutter means for cutting through a ground surface and a guide with a loading end located rearwardly of the cutting means and adapted for guiding earth from the loading end to an off loading end as the apparatus moves in a forward direction, wherein the cutting means is adapted for cutting through a ground surface along two laterally spaced paths in front of the loading end of the guide.

Preferably the apparatus is adapted to be coupled to a vehicle which is adapted to move the apparatus.

It is preferred that the loading end of the guide is substantially at ground level.

According to the present invention there is provided an apparatus for digging a trench including a cutter means for cutting through a ground surface along two laterally spaced paths, a guide with a loading end for excavating earth between the two paths and for guiding excavated earth to its off loading end and a frame supporting the cutting means and guide and adapted for connection to a mobile carriage.

It is preferred that the frame is adapted to be pulled along behind a vehicle such as a bulldozer.

According to one version of the invention the frame is adapted to be removably connected to a vehicle.

The frame may be connected to the back of a tracked vehicle.

According to another embodiment the apparatus is part of a vehicle which is custom made with the cutting means, guide and frame operable by control componentry associated with the vehicle.

The apparatus may include control means for controlling movement of the frame, guide and cutting means.

The control means may include a parallelogram linkage which interconnects the frame and the mobile carriage.

The apparatus preferably includes pivot means for pivoting the frame with respect to the control means.

The pivot means may include at least one pivotable member which is fixed to the frame.

The control means may include at least one piston with a piston rod connected to the frame.

It is preferred that the pivot means includes left and right pivotable members.

The control means may include left and right side pistons which are respectively connected to left and right side pivotable members.

Each piston may be pivotably connected to the mobile carriage.

The cutting means may include left and right side cutting devices.

Each cutting device may be a closed loop cutting chain or wheel.

The guide may be in the form of a chute.

The chute preferably h side walls extending upwardly and outwardly from a narrow base section.

The base is preferably in the form of a narrow gutter between the side walls of the chute.

The base section is preferably V-shaped.

The chute loading end may be adapted to gouge earth from the ground and scoop up the gouged earth.

It is preferred that earth scooped up by the chute is conveyed up the chute to its off loading end by movement of the apparatus in a forward direction.

According to another variation the base section includes a conveyor which moves scooped up earth to the off loading end.

It is preferred that the chute has a front face which is sharpened at the based section to enable excavation of earth as the apparatus moves in a forward direction.

The front face preferably has a lower portion which acts as a blade or ripper to cut into the earth.

It is preferred that the chute includes a plurality of rippers or tines which excavate earth from the ground so that it can be scooped up by the rest of the chute and transferred to the off loading end thereof.

The base section preferably includes a concave or V-shaped lowermost portion which flares upwardly and outwardly to the side walls which then flare upwardly and outwardly at a greater angle The base section may include a forwardly extending shovel portion.

The shovel portion may be provided with a sharpened front face and may extend across the face of the chute from one side to the other.

The upper face of the shovel may have a generally concave shape with forward most blade portions being located to the sides of the front face.

The guide is preferably arranged directly behind the cutting means.

It is preferred that the chute side walls are aligned with left and right side cutting devices respectively.

The chute may include a slewing section to enable excavated earth to be off loaded to one or both sides of the is trench which is dug.

It is preferred that the cutting means is fixed in position in relation to the chute so that both the chute and the cutting means are tiltable together.

It is preferred that the cutting means act to cut through earth and the chute acts to scoop up earth on either side of the cutting means approximately to the depth to which the cutting means have cut.

The apparatus may include a height adjustment means to vary the depth at which a trench may be dug.

The chute may include two channels which direct earth to either side of the trench as it is being dug.

A preferred embodiment of the present invention will now be described by way of example only with reference to the accompanying drawings in which:

DETAILED DESCRIPTION OF THE DRAWINGS

Figure 1:
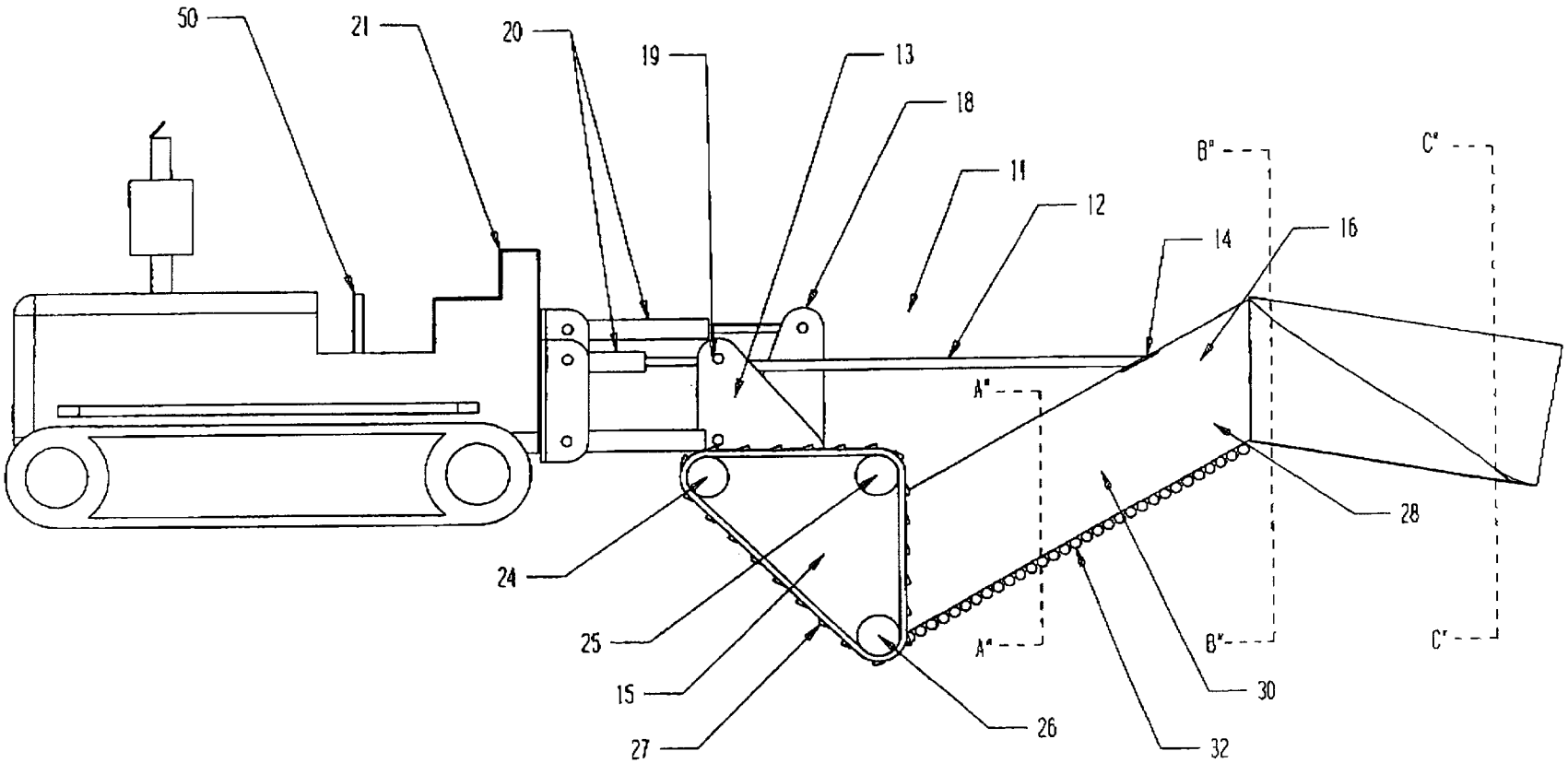
FIG. 1 shows a side view of an apparatus for digging trenches according to a first embodiment of the present invention.

As shown in FIG. 1 the apparatus for digging trenches 11 consists of a frame 12 located at an upper part of the apparatus and extending from a front end 13 to a rear end 14.

The frame 12 includes a pair of generally horizontally extending metal beams with interconnecting support beams and downwardly extending beams connected to various components of the apparatus.

The apparatus consists of two main components these include the cutting devices 15 located on both sides of the apparatus and the chute 16 which extends from behind the cutting devices 15 rearwardly and upwardly at an angle approaching 40 degrees.

Figure 2:
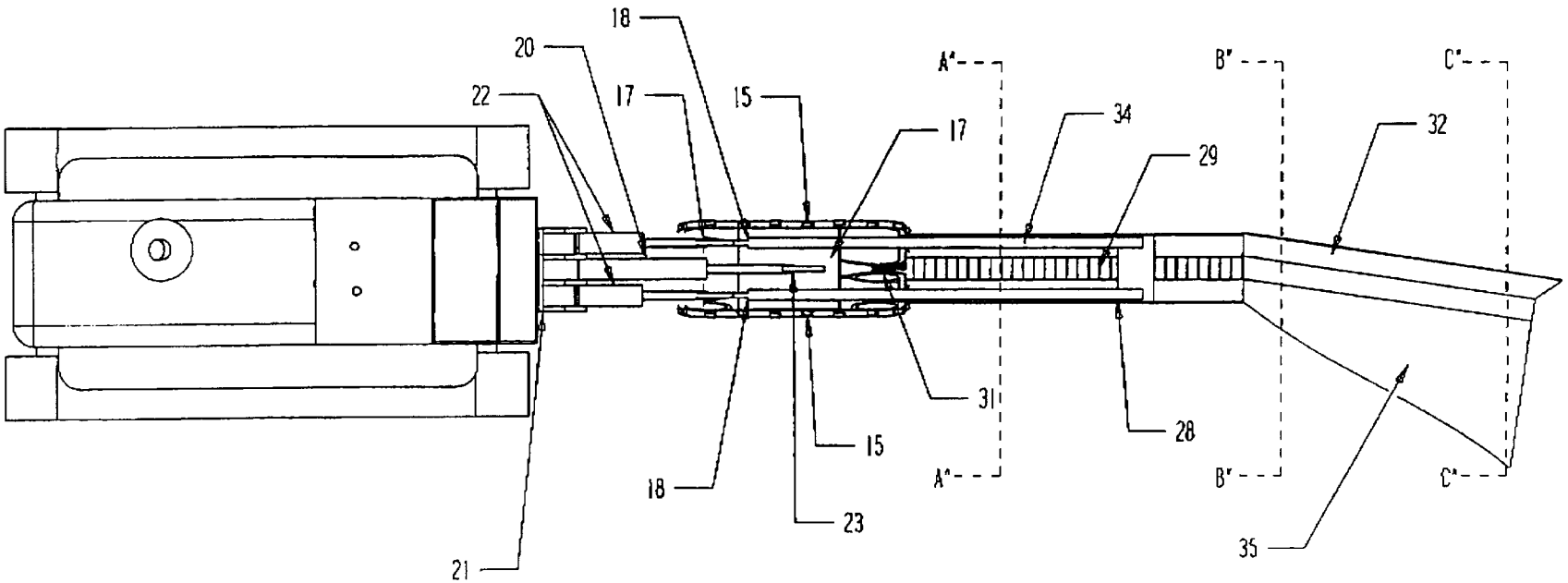
FIG. 2 shows a top view of the apparatus shown in FIG. 1.
Figure 5:
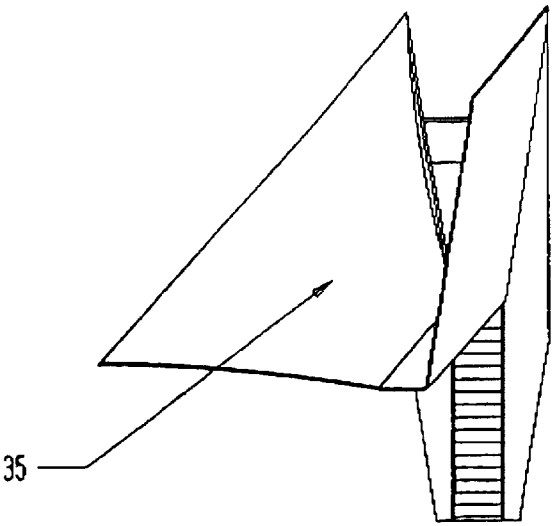
FIG. 5 shows a cross-sectional view C—C of a chute of the apparatus as shown in FIG. 1.
Figure 4:
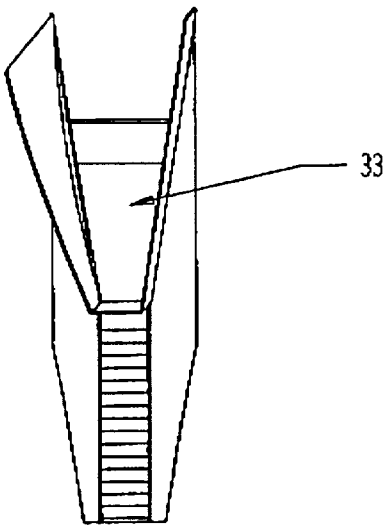
FIG. 4 shows a cross-sectional view B—B of the chute of the apparatus shown in FIG. 1.

As shown in FIG. 2 both cutting devices 15 are located on left and right sides of the apparatus. These are supported by the frame 12 which is mainly located above but also includes horizontal beams 17 which interconnect and support the cutting devices 15.

At the front end of the frame 13 two vertically disposed link plates 18 are provided which are narrowed at the top end 19 and connected together through a horizontal cross beam of the frame 12 to a piston rod assembly 20 pivotally connected to the rear end of a track dozer 21. As shown in FIG. 2 the cutting devices 15 and link plates 18 are arranged symmetrically on left and right sides of the apparatus 11.

The piston rod assembly 20 lifts and drops frame 12 and is located in alignment with the centre of the apparatus 11 and connected directly to a central part of the frame 12.

A lower part of each of the link plates 18 is pivotally connected to lower parallel links 22 located on either side of the apparatus 11 and interconnecting the back of the track dozer 21 to the link plates 18.

The link plates 18 as shown in FIG. 2 each consist of a parallel pair of plates with a gap located therebetween for the pivotal connection to the respective link 22. At the upper end of the link plates 18 a horizontal cross bean connects them together and the centre of this cross beam is connected to the piston rod assembly 20 which is able to move this horizontal cross beam and the associated frame 12 backwards and forwards in a tilting motion while the link plates 18 are able to tilt in a counter clockwise or clockwise direction depending upon movement of the piston rod assembly 20.

The piston rod assembly 20 may include a series of three separate piston cylinders and rods. A central one which connects directly to the middle of the frame and left and right side ones which connect directly to the top of each of the link plates 18.

A driving motor 23 is located between the link plates 18 and has a shaft located therethrough which is connected to a drive sprocket 24 on each of the cutting devices 15.

Each of the cutting devices 15 consists of three sprockets 24, 25, 26 located in a triangular arrangement with one point of each of the triangles at sprocket 26 located at the lowermost end of the cutting device 15, and the forward face edge of the cutting device as defined between sprockets 24 and 26, sloping downwardly and rearwardly to the lowermost point corresponding to sprocket 26.

A cutting chain 27 is located around the sprockets and when the sprocket 24 is driven the cutting chain is able to move in a clockwise direction to cut a ground surface.

The chute 16 has a generally V-shaped cross-section. However it is divided into an upper section 28 and a lower section 29. The lower section is in the form of a V-shaped gutter extending along the length of the chute while the upper section 28 consists of side walls 30 which flare outwardly at a greater angle than the angle of the side walls of the gutter 29.

At the front of the chute 16 the edge face thereof is generally angled forwardly and the base or gutter section 29 has a sharp cutting implement in the form of a ripper or sharpened shovel which projects downwardly to gouge or rip the earth in front of it as the apparatus moves forward. Various different shaped front faces of the chute may be used and additional tools may be added to assist in breaking up the earth so that it can be scooped up by the body of the chute as the apparatus moves along.

As shown in FIG. 1 the chute may be provided with a conveyor 32 in its base section. However this is optional and is not shown in any detail in any of the other figures.

The positioning of the cutting devices 15 with respect to the chute 16 is shown in detail in FIGS. 1 and 2. From these figures it is clear that the cutting devices are effectively aligned in parallel and collinear with the start of the upper section of the side walls of the chute 16.

The chute may be divided into two or more sections. For example as shown in FIG. 2 a second section may be provided at the back of the chute. This second section may be angled with respect to a first section at the front of the chute, so that earth excavated by the apparatus may be redirected to either side of the trench and deposited at either of these locations.

The inside shape of the chute in the second section 33 may be shaped so that earth moves effectively around a corner at the juncture between the first section 34 and the second section 33 of the chute.

The second section may be supported by the frame or lower supports such as wheels. Furthermore it may be pivotal in a horizontal plane to vary the angle of slowing.

Figure 7:
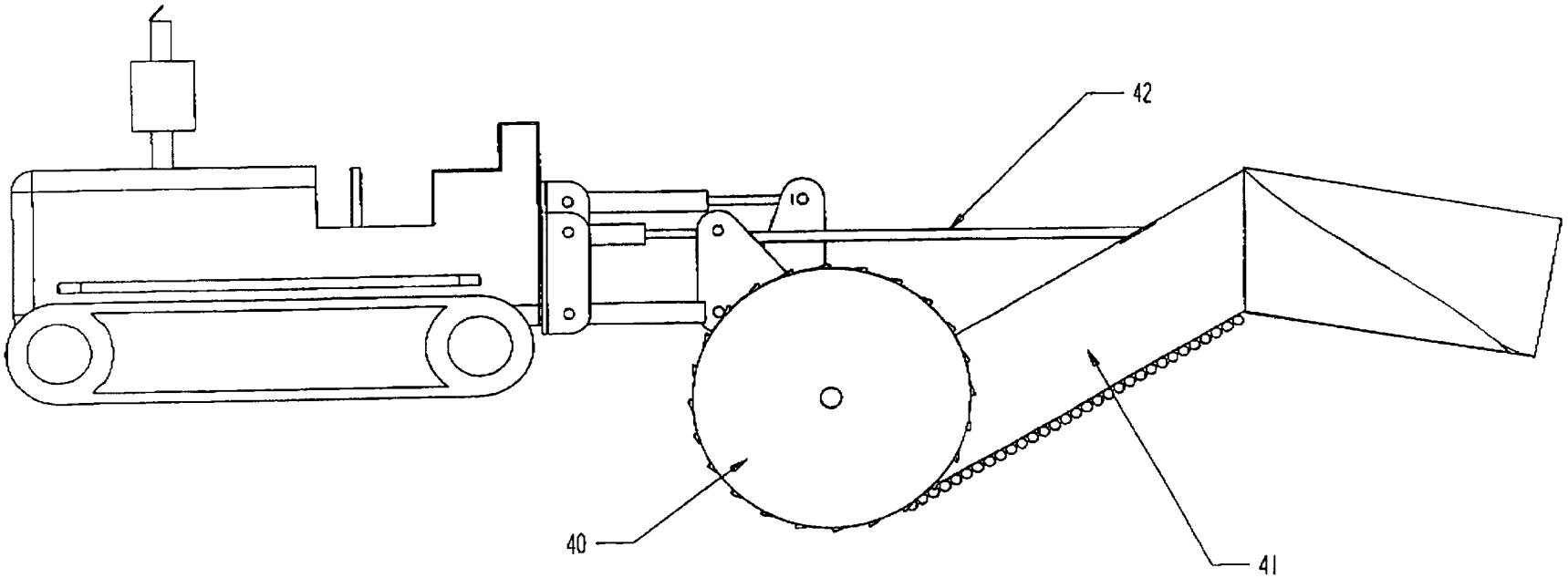
FIG. 7 shows a side view of an apparatus for digging trenches according to a second embodiment of the present invention.

According to another embodiment of the invention as shown in FIG. 7 the cutting devices 15 may be replaced by left and right side cutting wheels 40 which are aligned with each side of the chute 41 in a similar fashion to the first embodiment shown in FIG. 1.

Each of the cutting wheels 40 is desirably provided with cutting teeth around its periphery and is rotatable on a central axis connected to a mid part of the frame 42.

In operation the apparatus 11 connected to the back of the track dozer 21 is controlled by a person seated on the track dozer using one or more operating levers 50. The apparatus is tilted downwardly by controlling the piston assembly(s) through hydraulic connections. The apparatus is lowered until the cutting device is grounded and the cutting devices are then activated by turning on the motor located on the frame 12.

The cutting devices move the cutting chains in FIG. 1 in a clockwise direction and cut into the earth as the track dozer moves forward at a constant speed.

As the cutting devices cut into the ground and earth is moved forward by the cutting teeth of the cutting devices 15 the front end of the chute 30 scoops up earth between the cutting devices and this earth moves Upwardly towards the off loading end 28 of the chute 16.

Figure 3:
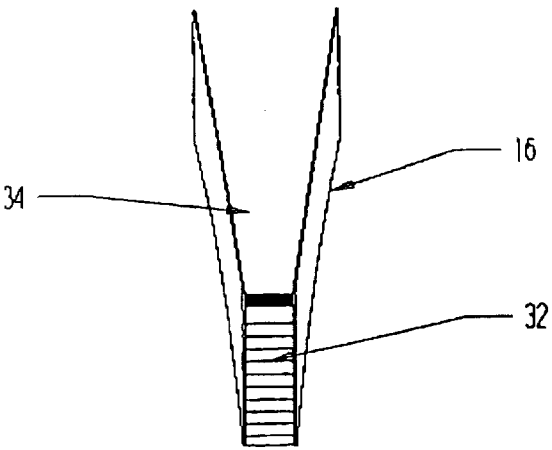
FIG. 3 shoos a cross-sectional view A—A of a chute of the apparatus shown in FIG. 1.
Figure 6:
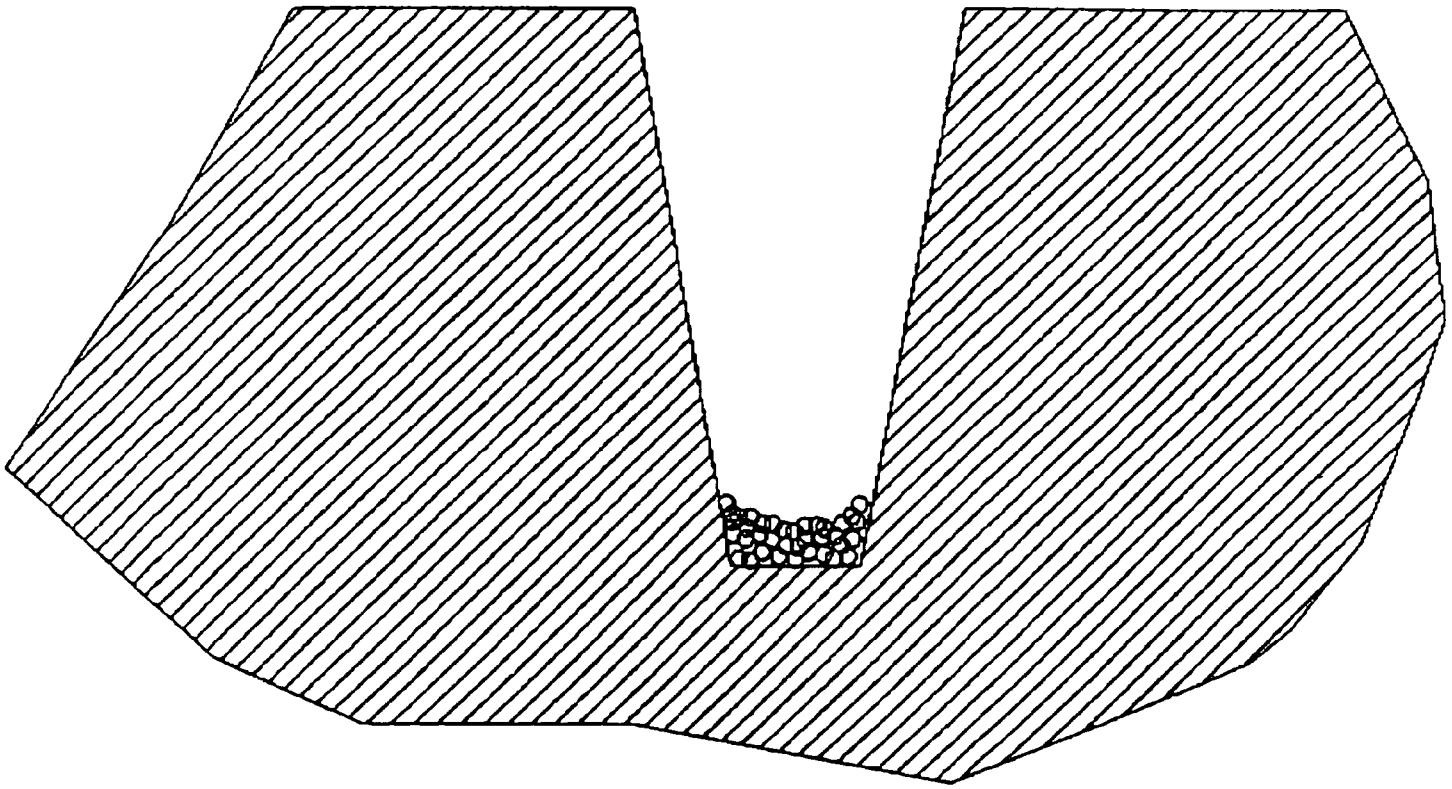
FIG. 6 shows a cross-sectional view of a trench which has been dug by the apparatus shown in FIG. 1.

As shown in FIG. 3 the front end of the chute 16 fills up with earth and this moves from the first section 34 to the second section 33 and due to the shape of the second section 33 is eventually deposited on one side of the trench which is dug.

As shown in Figure S the second section 33 skews to one side as it extends downwardly and this skewing eventually leads to earth being deposited under the action of gravity as it eventually falls off the lowermost side 35 of the second section.

Figure 10:
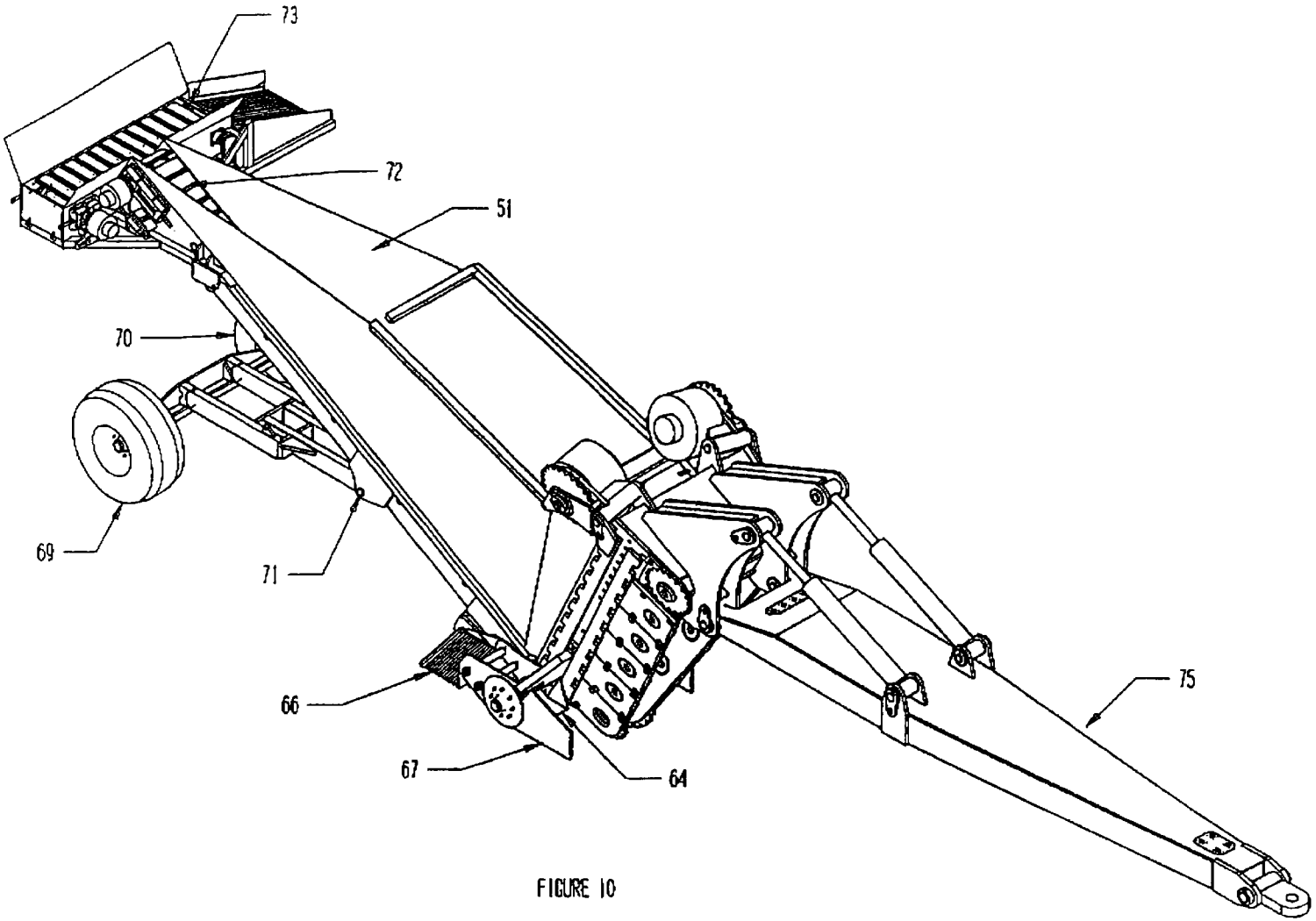
FIG. 10 shows the angled view of the apparatus shown in FIG. 8 with the front wheels removed.
Figure 11:
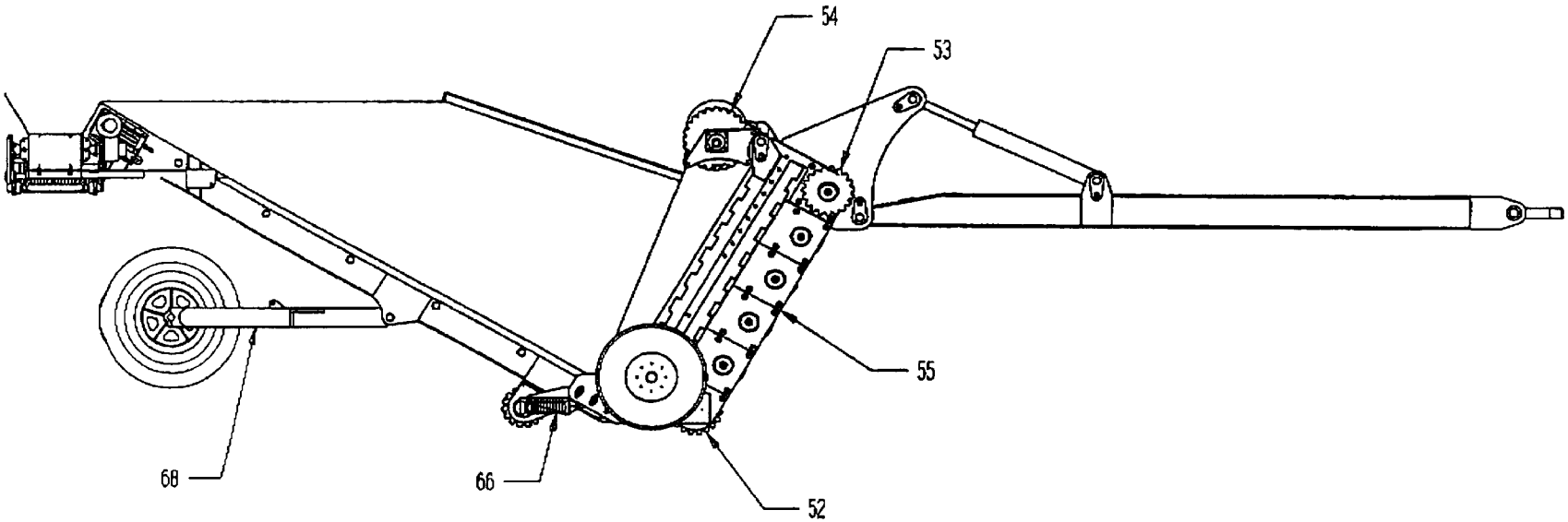
FIG. 11 shows a side view of the apparatus shown in FIG. 8.

According to the third embodiment of the present invention show in FIGS. 8 to 12, the apparatus 50 consists of a v-shaped chute 51 having cutting chains (not shown) located around three gear wheels 52, 53 and 54 respectively. These gear wheels are positioned at locations corresponding to drive sprockets 26, 24 and 25 respectively of the first embodiment. However in contrast to the first embodiment sprocket wheels 52 and 53 are mounted on generally rectangular panels which are inclined forwardly as best shown in FIG. 11.

Figure 12:
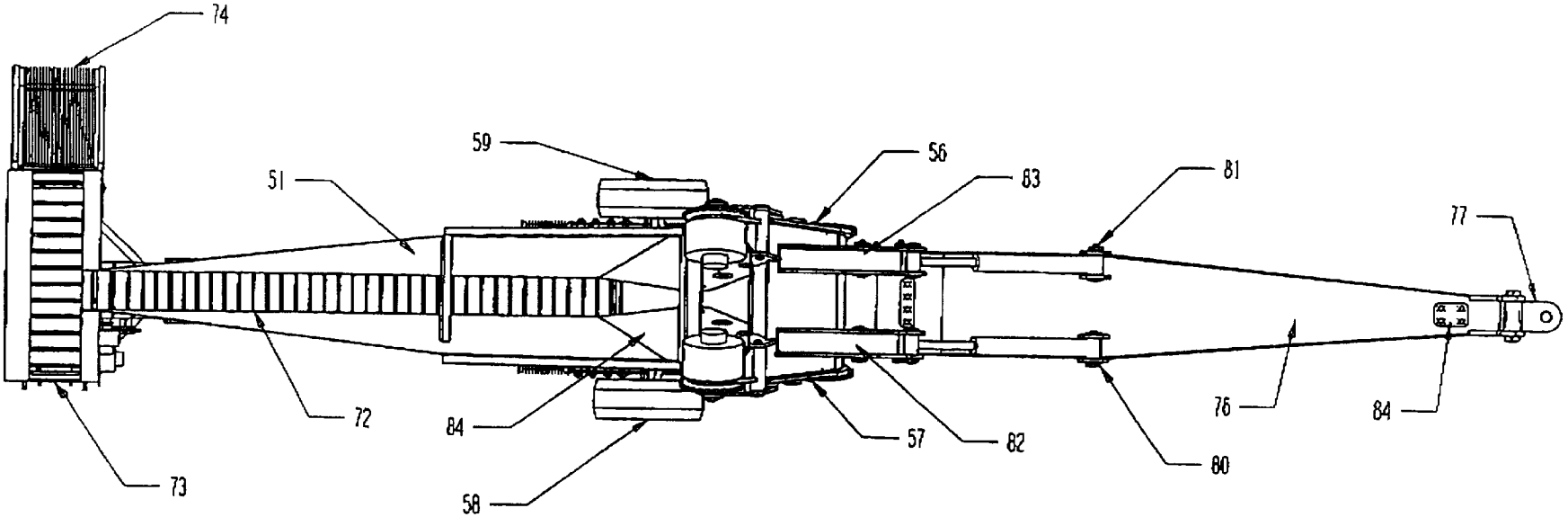
FIG. 12 shows a top view of the apparatus shown in FIG. 8.

FIG. 12 beat shows how these side panels of the cutting chains are positioned in front of the V-shaped chute 51 and diverge upwardly and rearwardly to allow excavated earth to be directed into the opening of the chute 51.

A V-shaped tine is preferably located between the opposing walls 56, 57 and extends downwardly from the opening of the chute 51.

Front wheels 58, 59 are located on short axles 60, 61 and are supported by supporting frame elements 62, 63 connected directly to respective side walls of the chute 51.

Scoops 64, 65 are positioned between each wheel and the adjacent side walls 52, 53 and serve to channel earth excavated on either side of the V-shaped chute 51 and cutting chins to the side of the chute 51 and behind it without interfering with the excavating operation.

FIG. 10 shows the scoop 64 more clearly as a result of wheel 58 being removed. Furthermore behind chute 64 a shaker tray 66 is located in order assist in depositing excavated earth which passes through scoop 64. A similar arrangement is located on the other side of the chute 51.

Side panel 67 is located on the outer wall of scoop 64 and serves to ensure excavated earth moves through the scoop 64 without interfering with wheel 58.

It is preferred that the rear end of the chute 51 is supported by a rear wheel assembly 68. This assembly as shown in FIG. 10 consists of a pair of wheels 69, 70 positioned on an axle which is connected through a supporting frame which is pivotally connected to the underside of an approximate midpoint 71 of the chute 51. The rear wheel assembly 68 may be lifted above ground level when the apparatus 50 is in use and may be lowered when the apparatus needs to be transported on a road.

The chute 51 has a conveyor 72 extending upwardly from close to the opening of the chute 51 to the end of the chute 51 where it then meets a transverse conveyor 73. The transverse conveyor 73 is designed to move to the left band side of the apparatus 50 and terminates in front of a shaker tray assembly 74 which is adapted to separate coarse and fine particles excavated by the apparatus 50.

The chute 51 is adapted to be pulled along behind a large vehicle such as a tractor. For this purpose a hitching assembly 75 is provided consisting of a draw bar 76 which is provided with a hitch 77 at its distal end and is pivotally connected at its proximal end to winged sections 78, 79 extending upwardly from the top of the opposing walls 56, 57.

The winged sections 78, 79 each consist of a pair of generally triangular metal plates which extend from a generally horizontally extending frame wall 90 extending between the tops of side walls 56, 57.

At the lower front end 91, 92 of each the winged sections 78, 79 lug sections of the draw bar 76 are positioned and pivotally connected between the opposing plates of each of the wing section 78, 79.

The draw bar 76 for a third of its length is generally of constant width but for the remaining two thirds of its length tapers inwardly to the hitch 77.

At the beginning of the tapering portion of the draw bar 76, anchoring lugs 80, 81 are located on either side thereof. Cylinders 82, 83 are pivotally connected to these lugs 80, 81 and their rods are pivotally connected at the opposite end to the top of each of the winged sections 78, 79.

A cover 84 closes an opening through which cabling, including electric, pneumatic and hydraulic, extends from the vehicle towing the apparatus. The cabling runs through a channel created inside the draw bar 76. At the proximal end (chute end) of the draw bar 76 the cabling merges and is then run to the various components for driving motors and cylinders.

In operation the apparatus 50 operates in a similar fashion to that described in relation to the previous embodiments. However in contrast the draw bar 76 is connected through the hitch 77 to a tractor which is provided with driving power for pneumatic, hydraulics and electrical components. These components include the conveyors, the cutting chains, the hydraulic cylinders, and the shaker trays.

In operation the cylinders 8, 83 are operable to adjust the degree of tilt of the chute 51 a cutting chains in order to vary the depth of excavation required. Once the degree of tilt has been sot the tractor moves in one direction pulling the apparatus 50 behind it.

The cutting chains 52, 53 cut into the ground and form a generally V-shaped cut with the bottom of the V completed by the tine or other trowelling or ripping type of excavating tool which is located between the opposite bottom ends of the cutting chains 52, 53 an on front of the chute 11.

As the apparatus 50 moves ford earth between the cutting chains 52, 53 moves into the chute 51 and is channeled through the tapered opening area 84 onto conveyor 72. The earth is then moved upwardly to the end of the chute 51 where it drops onto the transverse conveyor 73 and then moves to the left onto the shaker tray assembly 74 where it is eventually deposited in a straight line on the left hand side of the trench which is excavated by the apparatus 50.

The shape of the chute 51 may be varied in order to change the profile of the trench which is being dug and likewise additional components may be added to the outside of the apparatus 50 in order to assist with movement of earth which passes along the outside of the chute 51.

Although a pair of cutting chains are described in the preferred embodiment, a number of additional cutting chains or cutting implements may be added in front of the chute in order to assist with excavation of earth as the apparatus moves in a forward direction.

It in also possible for the wheels 58, 59 to be driven to assist with forward movement of the apparatus 50.

According to one variation of the present invention the chute 51 is provided with a cabin above the front end of the chute 51 and includes an engine for driving the apparatus. In such an embodiment rear wheels may be provided which are able be raised or lowered in order to adjust the degree of tilt of the chute and cutting implements with respect to a ground surface.

According to another embodiment a driving machine is located behind the apparatus 51 in order to move the apparatus 51 in a forward direction.

Additional components may be added to the apparatus in order to improve the ability of the apparatus to effectively excavate a trench.

Figure 8:
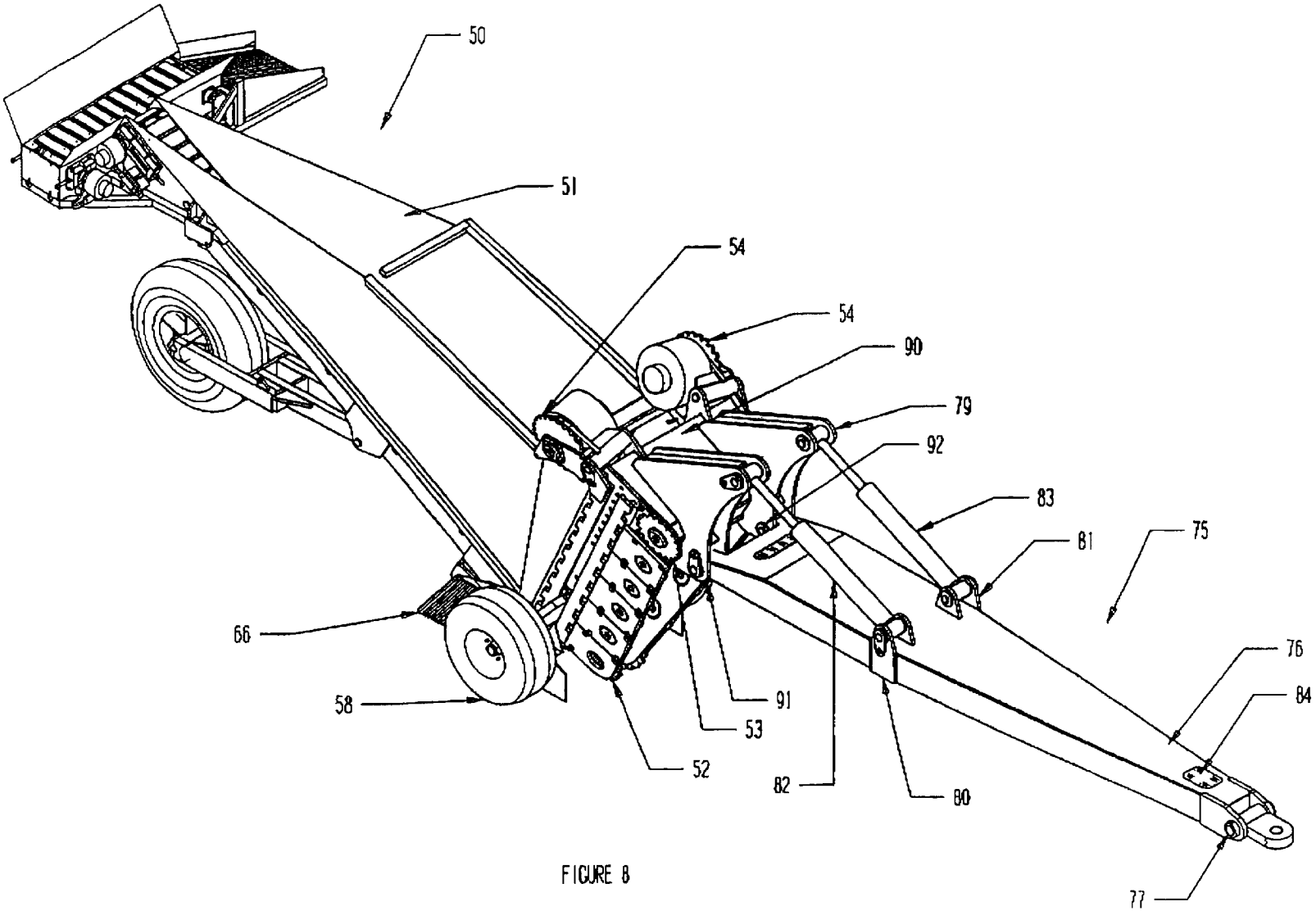
FIG. 8 shows an angled view of an apparatus for digging trenches according to a third embodiment of the present invention.
Figure 9:
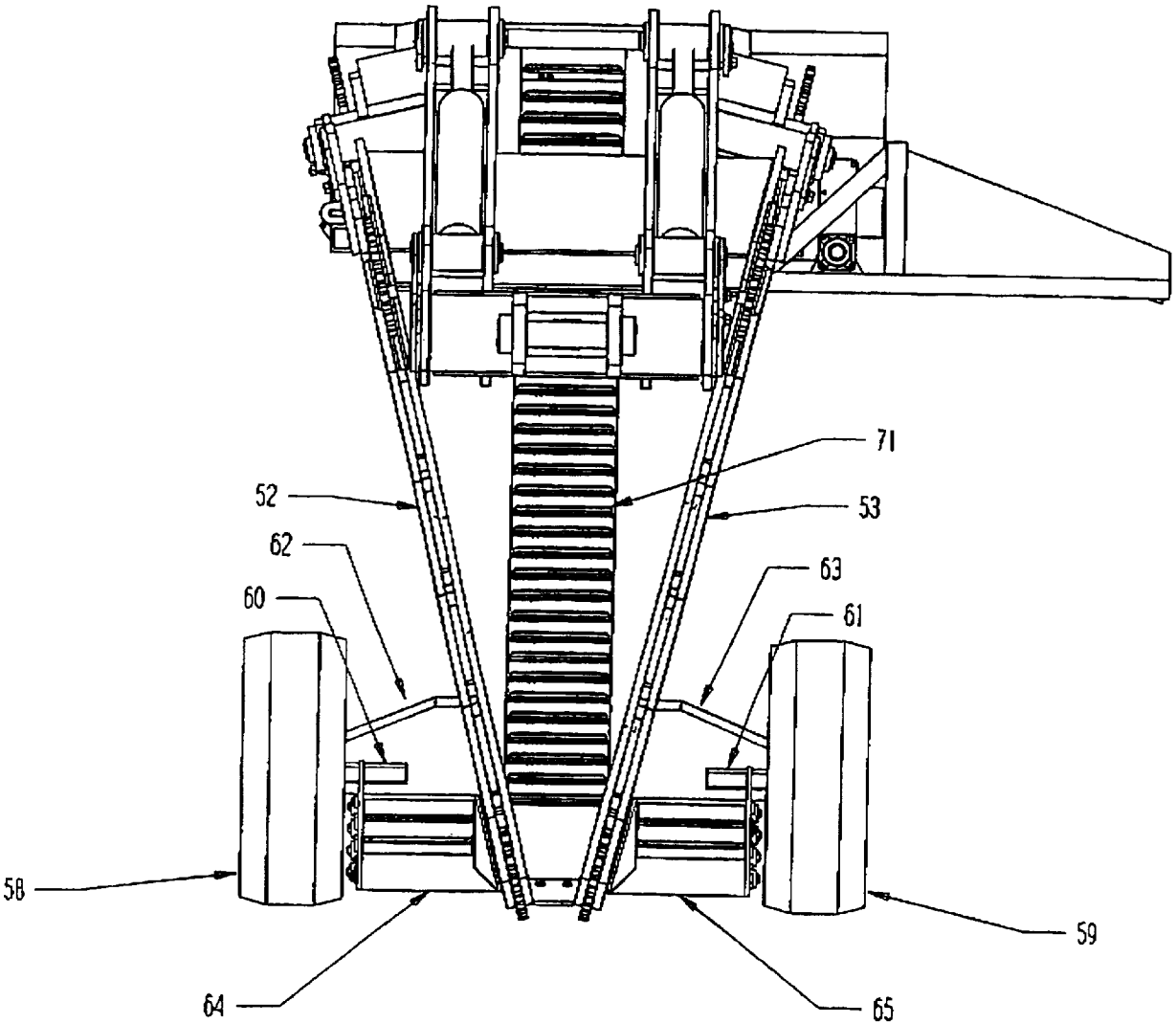
FIG. 9 shows a front view of the apparatus shown in FIG. 8.

It is also noted that in FIGS. 8 and 10 different rearward wheel assemblies are shown, one having a single wheel a the other having a twin wheel assembly.

The present invention also includes embodiments where the apparatus 11 is detachable from the track dozer and is able to be dragged along behind another machine. Furthermore the assembly interconnecting the truck dozer and the apparatus 11 may be varied to provide up and down tilting or backwards and forwards tilting as well as a slewing action.

What is claimed is:

1. An apparatus for digging a trench including a cutting means for cutting through a ground surface along two spaced paths, an excavation means configured to dig up earth from between the spaced paths cut by the cutting means and a guide with a loading end located rearwardly of the cutting means and adapted for guiding earth from the loading end to an off-loading end as the apparatus moves in a forward direction, wherein the cutting and excavation means are configured to dig a trench which increases in width from the bottom of the trench to the top of the trench.

2. The apparatus as claimed in claim 1 wherein the loading end of the guide is substantially at ground level.

3. The apparatus as claimed in claim 1, wherein the apparatus is adapted to be coupled to a vehicle which is adapted to move the apparatus.

4. The apparatus as claimed in claim 3 including a coupling means which is adapted to be coupled to a vehicle for moving the apparatus.

5. The apparatus as claimed in claim 4 wherein the apparatus includes a control means for controlling movement of the guide and cutting means.

6. The apparatus as claimed in claim 5 wherein the control means includes a tilting means for tilting the guide and cutting means.

7. The apparatus as claimed in claim 6 wherein the tilting means includes at least one piston rod assembly.

8. The apparatus as claimed in claim 7 wherein the coupling means includes a coupling frame which is pivotally connected to support members of the apparatus.

9. The apparatus as claimed in claim 8 wherein the tilting means includes a pair of piston rod assemblies which are connected between the support frame and the coupling frame.

10. The apparatus as claimed in claim 9 wherein the support frame comprises at least one upper portion of the apparatus which is adapted to be pivotally connected to the or each piston rod assembly.

11. The apparatus as claimed in claim 10 wherein the upper portion includes at least one lower part which is pivotally connected to the coupling frame.

12. The apparatus as claimed in claim 11 wherein the support frame comprises a pair of upwardly extending wing portions which are pivotally connected to a pair of piston rod assemblies which at their opposite ends are pivotally connected to the coupling frame.

13. The apparatus as claimed in claim 12 wherein the support frame is located at a forward upper end of the apparatus.

14. The apparatus as claimed in claim 13 wherein the control means includes a parallelogram linkage which interconnects a front end of the apparatus to a mobile carriage.

15. The apparatus as claimed in claim 14 including an off loading guide means which is adapted to guide earth from the off loading end of the chute to one side of the apparatus.

16. The apparatus as claimed in claim 12 wherein the cutting means includes adjustment means for varying the orientation of cutting devices of the cutting means.

17. The apparatus as claimed in claim 16 wherein the cutting means includes chains with cutting implements located thereon.

18. The apparatus as claimed in claim 1 wherein the cutting means includes left and right side cutting devices.

19. The apparatus as claimed in claim 18 wherein the left and right side cutting devices are a closed loop cutting chain.

20. The apparatus as claimed in claim 18 wherein the left and right side cutting devices are a cutting wheel.

21. The apparatus as claimed in claim 18 wherein the guide comprises a chute having side walls extending upwardly and outwardly from a base section.

22. The apparatus as claimed in claim 21 wherein the chute is inclined upwardly from the loading end to the off loading end.

23. The apparatus as claimed in claim 22 wherein the base comprises a gutter between the side walls of the chute.

24. The apparatus as claimed in claim 23 wherein the chute comprises a conveyor which extends from the loading end to the off loading end.

25. The apparatus as claimed in claim 24 wherein the loading end includes an excavation tool.

26. The apparatus as claimed in claim 25 wherein the excavation tool includes at least one tool from a group of tools including rippers, tines, shovels, blades and scoops.

27. The apparatus as claimed in claim 26 wherein the cutting means includes cutting implements which are oriented substantially parallel with the side walls of the chute.

28. The apparatus as claimed in claim 1 wherein the guide has a base section which is substantially V-shaped.

29. The apparatus as claimed in claim 28 wherein the guide loading end is adapted to gouge earth from the ground and scoop up the gouged earth.

* * * * *

UNITED STATES PATENT AND TRADEMARK OFFICE

CERTIFICATE OF CORRECTION

PATENT NO. : 6,625,908 B1 
DATED : September 30, 2003
INVENTOR(S) : Darren Cardiff and Steven Nuttall It is certified that error appears in the above-identified patent and that said Letters Patent is hereby corrected as shown below:

Column 8,
Line 50, replace "12" with -- 15 --

Signed and Sealed this

Twenty-seventh Day of January, 2004

JON W. DUDAS
*Acting Director of the United States Patent and Trademark Office*